US009328937B2

(12) United States Patent
Tomlinson et al.

(10) Patent No.: US 9,328,937 B2
(45) Date of Patent: May 3, 2016

(54) VARIABLE RATE HEATING FOR AGRICULTURAL PURPOSES

(75) Inventors: John L. Tomlinson, Onalaska, WI (US); Carl A. Lind, Onalaska, WI (US)

(73) Assignee: L.B. White Company, Inc., Onalaska, WI (US)

( * ) Notice: Subject to any disclaimer, the term of this patent is extended or adjusted under 35 U.S.C. 154(b) by 971 days.

(21) Appl. No.: 13/489,007

(22) Filed: Jun. 5, 2012

(65) Prior Publication Data

US 2012/0312885 A1 Dec. 13, 2012

Related U.S. Application Data

(60) Provisional application No. 61/494,235, filed on Jun. 7, 2011.

(51) Int. Cl.

| | |
|---|---|
| ***F24D 19/10*** | (2006.01) |
| ***F24D 7/00*** | (2006.01) |
| ***F24F 11/053*** | (2006.01) |
| ***F24F 11/00*** | (2006.01) |

(52) U.S. Cl.

CPC ..... *F24F 11/053* (2013.01); *F24F 11/0001* (2013.01)

(58) Field of Classification Search

CPC ..... F24F 7/00; F24F 11/0001; F24F 11/053; A01K 31/15; A01K 31/18; A01K 31/19; A01K 31/20

See application file for complete search history.

(56) References Cited

U.S. PATENT DOCUMENTS

| | | | | | |
|---|---|---|---|---|---|
| 3,976,243 | A | * | 8/1976 | Christophel | 237/3 |
| 4,249,461 | A | * | 2/1981 | Christenson et al. | 454/269 |
| 4,333,002 | A | * | 6/1982 | Kozak | 392/451 |
| RE31,023 | E | * | 9/1982 | Hall, III | 405/37 |
| 4,389,706 | A | * | 6/1983 | Gomola et al. | 702/182 |
| 4,517,921 | A | * | 5/1985 | Haythornthwaite | 119/448 |
| 4,546,917 | A | * | 10/1985 | Cormary et al. | 236/44 C |
| 4,559,441 | A | * | 12/1985 | Rudich et al. | 392/347 |
| 4,626,662 | A | * | 12/1986 | Woolf | 219/501 |
| 4,694,192 | A | * | 9/1987 | Payne et al. | 700/295 |
| 4,719,874 | A | * | 1/1988 | Maurice | 119/306 |

(Continued)

FOREIGN PATENT DOCUMENTS

| | | | | | |
|---|---|---|---|---|---|
| EP | 0100214 | A2 | * | 2/1984 | |
| JP | 62248930 | A | * | 10/1987 | F24C 7/08 |

*Primary Examiner* — Alissa Tompkins
*Assistant Examiner* — Phillip E Decker
(74) *Attorney, Agent, or Firm* — Charles S. Sara, Esq.; DeWitt Ross & Stevens SC

(57) ABSTRACT

An exemplary temperature control system for animal confinement buildings includes an agricultural heater and a ventilation system. The agricultural heater is modified to be a variable rate heater using SmartBox technology or by applying appropriate control logic and outputs to a conventional room controller. A heat on/off relay of the room controller can serve as an enable signal connected to the SmartBox. Heating is controlled using a proportional-plus-integral algorithm for error correction. Error correction may be ceased when temperatures fall within a dead band. Heat is turned on when the temperature drops to an on temperature equal to a set point minus 0.5F. Heat can be turned off when the heater has been at a minimum output level for a minimum output period (such as 90 seconds) and the temperature has not dropped below the on temperature during the minimum output period. An auto-variable radiant brooder may be incorporated.

22 Claims, 11 Drawing Sheets

(56) References Cited

U.S. PATENT DOCUMENTS

| | | | | |
|---|---|---|---|---|
| 4,919,084 | A * | 4/1990 | Maurice | 119/306 |
| RE33,600 | E * | 6/1991 | Timmons | 236/49.3 |
| 5,060,629 | A | 10/1991 | Sirand | |
| 5,492,082 | A * | 2/1996 | Krevinghaus et al. | 119/448 |
| 5,549,099 | A | 8/1996 | Sirand | |
| 6,321,687 | B1 * | 11/2001 | Lemmon et al. | 119/448 |
| 6,360,955 | B1 | 3/2002 | Hoff et al. | |
| 7,044,397 | B2 * | 5/2006 | Bartlett et al. | 236/49.3 |
| 7,177,534 | B2 * | 2/2007 | Jones et al. | 392/360 |
| 7,189,947 | B2 * | 3/2007 | Fulton | 219/490 |
| 7,404,262 | B2 * | 7/2008 | Jurkovich et al. | 34/381 |
| 7,523,762 | B2 * | 4/2009 | Buezis et al. | 137/613 |
| 7,809,472 | B1 * | 10/2010 | Silva et al. | 700/277 |
| 7,997,004 | B1 * | 8/2011 | Adrian | 34/227 |
| 2006/0065753 | A1 * | 3/2006 | Fauret | 236/49.3 |
| 2006/0276956 | A1 * | 12/2006 | Johnson | 701/115 |
| 2007/0043477 | A1 * | 2/2007 | Ehlers et al. | 700/276 |
| 2009/0216775 | A1 * | 8/2009 | Ratliff et al. | 707/10 |
| 2010/0070092 | A1 | 3/2010 | Winter et al. | |
| 2011/0259446 | A1 * | 10/2011 | Ueki et al. | 137/487.5 |

* cited by examiner

VARIABLE RATE HEATING FOR AGRICULTURAL PURPOSES

CROSS-REFERENCE TO RELATED APPLICATIONS

This application claims priority under 35 USC §119(e) to U.S. Provisional Patent Application 61/494,235 filed Jun. 7, 2011, the entirety of which is incorporated by reference herein.

FIELD OF THE INVENTION

The present invention is directed to heating systems for agricultural buildings in general and specifically to a variable rate heating system used in an agricultural animal confinement production building setting.

BACKGROUND OF THE INVENTION

The agricultural industry is facing difficult and challenging times with the increases in the costs of energy and animal production and the associated decline in profitability. This situation leads to pressure to improve profitability by reducing operating costs.

One way of reducing energy costs and energy consumption is by improving how heat is controlled and managed in an animal confinement building. Traditionally in North America, control of heating is simply the use of an "on" or "off" switch. This typically results in increased energy consumption due to overshoot and undershoot. The alternative control approach is "heat to demand." The amount of heat provided is that required to maintain temperature. It is increased or decreased (i.e., modulated) as needed to maintain temperature. This technology has been developed and applied in European confinement buildings as well as in commercial/industrial products such as boilers and furnaces and has progressed to residential heating applications.

In an agricultural building, such as a swine production building for the farrowing, nursery, finisher, or wean-to-finish grow phases, the environmental conditions are managed by a room temperature controller, i.e. environmental or temperature controller, that controls both heat and ventilation. With these devices, the heat is either "on" or it is "off." The temperature of the room is typically measured by at least two sensors in the room. As the room temperature rises above the Setpoint used to manage the room conditions, activation of ventilation can occur. On the heat side, if the temperature drops below the Setpoint by a certain amount, heat is activated.

In the example conventional (on/off) ventilation and heat control system shown in FIG. 1, the control logic or philosophy is "not to exceed." The reference temperature is referred to Daily Required Temperature (DRT); sometimes also referred to as Setpoint. As described below, the control logic does not attempt to maintain or control to the DRT temperature but rather simply to ensure that the DRT is not exceeded. If the actual room temperature starts to go warmer than DRT then the ventilation comes in to play. If the actual room temperature drops sufficiently below DRT the heating system comes in to play. On the ventilation side, there is always a minimum amount of ventilation passing through a swine building to maintain indoor air quality for the animal. This is accomplished either on a continuous rate, where one or more fans may continuously run at partial speed, or it may by conducted on "cycle time," where it runs at a set rate, e.g., one minute out of four. In addition to the minimum ventilation added to maintain air quality, ventilation can be provided in stages if the room starts to get too warm. This typically is accomplished by using a variable rate fan at, for example, 40 percent capacity, and then ramping it up to full output. If the temperature continues to rise, another variable rate fan can be activated, and so on. Conventional systems include:

(1) Ventilation Mode
- a) As actual room temperature exceeds DRT.
  - i) Minimum ventilation, typically running at 50% motor speed, the control starts to increase motor speed at DRT+0.1F.
    - (a) Typically at DRT+2F the motor is up to 100% speed
      - (i) The +2F is referred to as bandwidth
  - ii) If the minimum ventilation fan is at 100% and actual room temperature continues to increase
    - (a) A second fan, typically starting at 50% speed starts and ramps up to full speed at DRT+4F
  - iii) If additional stages are required to reduce temperature then they add in as described for the minimum vent/first stage and $2^{nd}$ stage above
  - iv) When actual room temperature starts to drop the reverse process occurs, i.e. motors start to ramp down and stages drop out if no longer needed until ultimately ventilation is back to the minimum ventilation settings (2) Heating Mode
- a) As actual room temperature drops below DRT −3F, then the heater is turned on
  - i) This temperature is typically referred to as the "offset," i.e. how much it is offset from the DRT
  - ii) As actual room temperature then starts to increase at DRT−1F the heater is turned off
    - (a) The difference between "on" and "off" temperatures is typically referred to as the "differential"
  - iii) The use of "offset" and "differential" is established by the producer based on several parameters including the size of the room and the amount of heat being provided.
    - (a) Offsets and differentials are utilized to keep the heat "momentum" being created by the sudden addition of heated air from causing the actual temperature to exceed DRT and start the ventilation cycle which in turn wastes fuel
  - iv) The "Drift" that occurs with conventional systems, typically 5-7 degrees Fahrenheit, is due to the time it takes to start warming the air, during which actual temperature continues to fall, and then stop heating after the heaters are turned off but the temperature continues to rise There are four major integrated room or building control manufacturers in the swine marketplace today providing a 0-10 volts direct current ("vdc") control outputs for heating control. These controls presently do not contain the necessary control logic capability to properly manage either forced air or radiant modulating heaters. First, an Israel company, Rotem (Petach Tikva, Israel) (see http://www.rotem.com/), produces a "PIGUARD" room controller system (see http://www.rotem.com/pig-farming/superguard_and_piguard), which features temperature and humidity sensors for optimizing environmental control in the pig house industry. Secondly, GSI Electronics (formerly known as Thevco Electronics) (Quebec, Canada) (http://www.thevco.com/corporate.htm), which manufactures management systems for swine, poultry and dairy cows and is sold in the USA as Aerotech or Automated Products devices. Additionally there are products manufactured by Monitrol Inc. (Quebec, Canada) (http://www.monitrolcorp.com/), and Dicam (UK) (http://www.dicamusa.com/).

The technology to create gas-fired heating products that incorporate the ability to function as "heat to demand" or modulating heaters is known. The modulating heaters can be either direct-fired forced air convection heaters or high intensity radiant heaters. To better meet the needs of the market for the future, control manufacturers need to provide appropriate controls with the necessary control logic and outputs to start and control modulating heaters. Additionally, to address the existing installed population of controls a means is needed to integrate with the existing on-off control and modulating heating devices in order to achieve the benefit of variable rate heating.

SUMMARY OF THE INVENTION

The invention, which is defined by the claims set forth at the end of this document, is directed to variable rate heating systems which at least partially alleviate the aforementioned problems. A basic understanding of some of the features of preferred versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

The overarching Object of this invention is to enhance fuel efficiency and improve animal health and production productivity by modulating heat output as needed to maintain a precise, consistent temperature within the animal confinement facility. This overarching Object is achieved by accomplishing the following sub-Objects:

- Treat the management of heating and ventilation in the agricultural animal confinement environment in a systematic, integrated manner.
  - Dynamic management of temperature in the heating mode. Addressing the two forms of heating typically used—direct-fired forced air heaters and high intensity radiant brooders; as individual types of heaters or in combination.
  - Eliminate the potential for ventilation to be increased due to an inadvertent increase in air temperature caused by the heating system.
- Precise temperature control—minimal variation in room air temperature or animal occupied zone temperature
  - Ability to set, Heating Setpoint, temperature to the optimum required for the animal at any stage in the grow phase.
- Consistent temperature control—consistent throughout the animal confinement room
  - In the case of direct-fired forced air heaters to provide for approaching continuous operation with the result that the heater becomes an integral part of the air circulation within the room.
- There are two basic forms of confinement heating: forced air convection heat and radiant heat. In the case of direct-fired forced air convection heating the overall room air temperature is managed. In the case of radiant heating for proper, energy efficient management of radiant heat in the (for example) swine environment, where the radiant heat zone has a higher temperature than the room temperature, the radiant heat zone is managed independently from the room air temperature. Proper management of radiant heat at the animal level allows the overall room temperature to be cooler thus yielding additional energy savings.

The present invention is first directed to the concept of adapting a conventional direct-fired forced air convection heater to make it variable rate, by incorporating a variable rate modulating gas valve into the heater along with a means to control the heater and the building ventilation system. This heater configuration, a direct-fired variable rate forced air convection heater, can be achieved by either field conversion of an existing installed heater or in a new, production built heater. The present invention secondly is directed to the concept of adapting an existing modulating-capable high-intensity radiant heater along with a means to control gas flow to the heater and with the means to provide an appropriate temperature reference to control the heater and building ventilation. The present invention thirdly is directed at controlling both direct-fired forced air convection heating and radiant heating as described above with the means to control the heaters and building ventilation.

The means to control the heater, forced air or radiant, in conjunction with an existing room controller managing the building ventilation system is known in this disclosure as the "SmartBox™ Technology" (hereinafter the "SmartBox"). The SmartBox is a variable rate temperature controller, specifically for integrating with an existing on/off room temperature control, which will manage the variable heat to the environmental temperature requirement in the room. The SmartBox works in conjunction with the room ventilation controller so that the variable rate temperature controller operates in concert with the ventilation system and not in interference with the ventilation system. The SmartBox technology does not manage ventilation, only heat.

The SmartBox technology can be installed in an existing room system, with its current on/off room temperature controller, to control the heat at a variable rate. A variable rate gas valve can be installed into an existing heater, and the SmartBox incorporated in a system and linked to the existing room controller to convert a heating system into a variable rate heating system. The variable technology and the SmartBox Technology that operates the system to let the system manage the ventilation and the heat on a variable basis have not heretofore been shown.

Temperature control is entirely automated. In the case of direct-fired forced air convection heating, the SmartBox and the existing room controller adjust based strictly on room temperature (as measured using temperature sensors in the room). Temperature sensors may be positioned at (for example) opposing corners of the room. The locations of the sensors are determined as necessary through experience and practice to properly represent the temperature environment. An existing room controller may use multiple sensors and average results to obtain an overall average room temperature for purposes of control.

Because existing room temperature sensors may not be able to directly interface with the SmartBox device (as there might be no way to take the output of a temperature sensor and route it to both the existing room controller and the SmartBox), the SmartBox preferably includes separate temperature sensors that can be positioned similarly to the standard room sensors.

If the room temperature elevates over a desired Setpoint, the heating system will be turned off and the ventilation system will come into play in incremental steps as described above. If the room becomes too cool relative to the Setpoint, then the current room controller (the on/off controller) will register a need for heat. This enables the controller of the present invention to control the heater. The controller activates the heater, i.e., turns it on, and then manages the rate as it needs to maintain temperature. The controller of the present invention can control within 0.5 degrees Fahrenheit of the room temperature, which is more precise than the typical 5-7 degrees Fahrenheit variation experienced with conventional on-off control. Therefore, the controller of the present invention does not function unless the room controller indicates a need for heat. If the room controller registers a need for heat, the control is activated to generate heat.

An important feature of this invention is the ability to maintain the room "at temperature" (or very close thereto). In most situations, thermostatic controls and the like will keep the room approaching the desired temperature from the heat or cold side. With on-off control, you are never at temperature and the average temperature will be lower than the desired set point to avoid heat-ventilation interactions. However, agricultural buildings need more precise conditions. The whole purpose for this is that temperature and ventilation conditions in agricultural systems, particularly in the swine industry or poultry industry, must be more precise. A variation of even a degree or two could have fairly serious effects on the maintenance and condition of the animals.

For example, on the first days in a nursery in a swine facility, the room temperature should be 85 degrees Fahrenheit. The rooms are also running at minimum ventilation at the same time to provide the necessary indoor air quality. If the temperature drops below the desired 85 degrees Fahrenheit at some point, depending on the settings of the control, the heat will turn on. As the temperature increases the heat is turned off. If the additional heat causes the temperature to rise above 85 degrees Fahrenheit, then the controller will be activated to increase ventilation to cool the room by bringing more air flow through the building. If the room is cooled too quickly, then the cycle of adding heat starts again. The system of the present invention solves these discrepancies.

Further, temperature variations with swine could change their feed intake. If pigs get too cold, their food intake may be used to generate heat to the detriment of their size. If the pigs get too hot they will reduce their feed intake and use energy by increasing their respiration rate to cool themselves. Pigs require a fairly narrow productive temperature range. Outside that range could impact their health and productivity.

Therefore, the present variable rate heat technology provides a more precise and optimum temperature range for the pig by eliminating the 5-7 degrees Fahrenheit swing and reducing that to down to less than one degree Fahrenheit. That gives the animal a much more consistent temperature.

Conventional control logic does not manage to a specific temperature, DRT, but is rather intended to keep the temperature in a range that is considered to be acceptable; not greater than DRT and within an acceptably lower range below DRT. To achieve precise, consistent temperature a separate, from DRT, Heating Temperature Setpoint is required. We know from observation that the typical average room temperature when in the heating mode is about DRT −2F. This temperature may be used as the Heating Temperature Setpoint or can be otherwise selected by the user up to as close as −0.5F below DRT. With exemplary variable heating systems, whether the heat mode is being managed by the SmartBox or by a control output from the room control, the management of the ventilation does not change.

With young pigs, particularly in the wean to finish grow phase, it is more effective to heat the pigs with radiant energy than air temperature. This is most important in the first 10-14 days as the pigs establish their own immunity after separation from the sow. The desire is to obtain an average temperature representative of the temperature area where the pigs are laying—the animal occupied zone. The optimum average temperature for this area is when the pigs are not piled on each other because they are too cold nor is there a gap in the center of them because the area is too warm—pigs laying close together in a single layer on the floor. To use radiant heat effectively a means is necessary to measure or determine the temperature at the pig level in this animal occupied zone. A method has been established to determine the average temperature of the animal occupied zone. With this method a mounting bracket and sensor holder can be designed such that the temperature sensed by the temperature sensor installed in the sensor holder is representative of the average temperature at the animal occupied zone. The temperature measured by the sensor installed in the holder is a combination of radiant energy from the radiant heater and convective heat energy from the floor area. The sensor is not measuring air temperature within the room. As an example in a typical wean to finish operation the air temperature Setpoint may be 74° F. and the animal occupied zone target temperature may be 88° F.

Exemplary Uses for Invention

This invention has wide application in the agricultural field, such as poultry and swine. The technology is applicable to the poultry market but clearly with the high intensity radiant heaters and number of control zones being utilized, the control would require a greater number of temperature inputs as well as an increased number of control outputs.

The swine market opportunity for using variable rate heat control falls into two categories. The first is new construction. In new construction if a conventional on-off heat control is utilized, then the SmartBox technology is required. In the alternative, the latest generation integrated controls with proper capability to manage variable rate heating would have to be specified. The second is a retrofit to existing installations. With retrofit construction, the existing room controller would have to be supplemented with the SmartBox variable rate heating control.

The objects and advantages of the invention will appear more fully from the following detailed description of the preferred versions of the invention made in conjunction with the accompanying drawings and attachments.

Further advantages and features of the invention will be apparent from the remainder of this document in conjunction with the associated drawings.

DETAILED DESCRIPTION OF PREFERRED VERSIONS OF THE INVENTION

Figure 1:
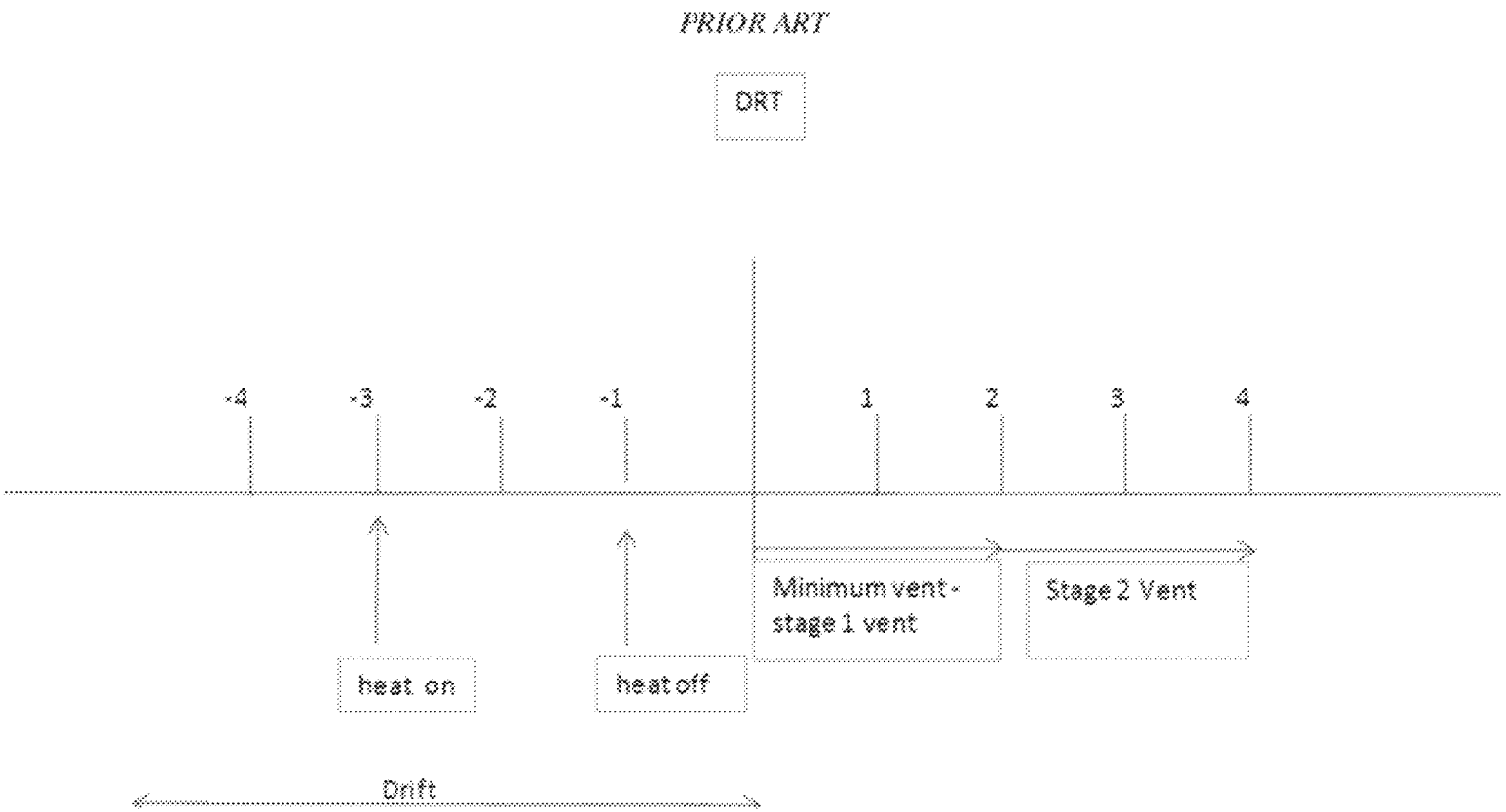
FIG. 1 is a representation of conventional heating systems that incorporate a simple heat on/heat off control mechanism. Such systems tend to result in a large drift of five to six or more degrees Fahrenheit in the environment in which they function.
Figure 2:
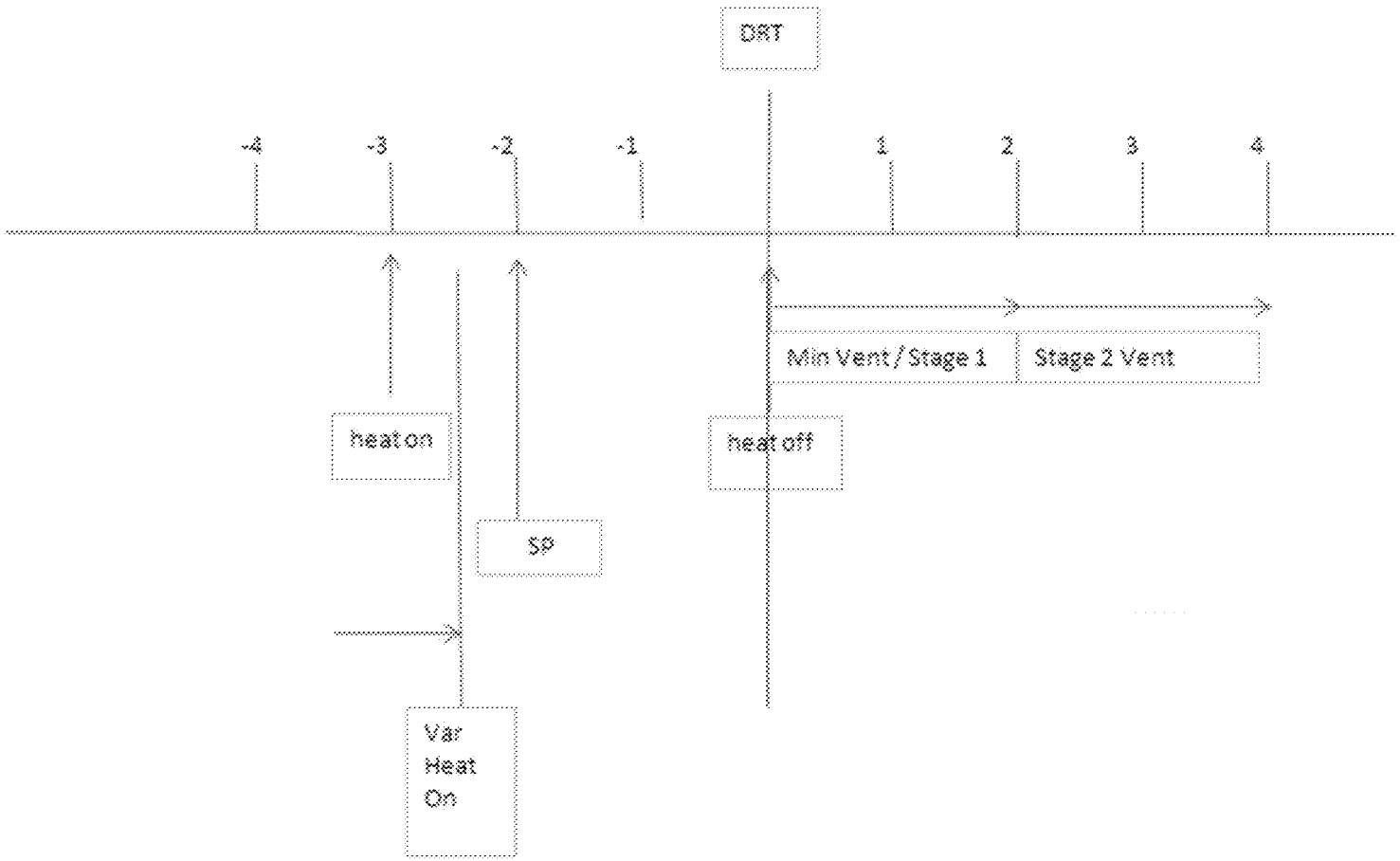
FIG. 2 is a representation of an exemplary control logic that accomplishes a smaller temperature drift. It may be incorporated in a system with a room controller and a SmartBox. The room controller provides power to the variable heat controller through the "heat on" and "heat off" points. Variable heat is given "permission" to manage the availability of heat to temperature within the selected variable on and off points. In the version shown, the Ventilation Mode operates as described with respect to the conventional management system. The heat mode, however, is set up as follows: heat on=DRT −3F; heat off=DRT. It is noted that the heat on-off relay in the existing room control serves as a digital enable for the SmartBox. The 3F span gives the SmartBox room to control temperature yet assures that heat will be off before DRT is exceeded. The SmartBox is set as follows: Heat Setpoint DRT −2F; heat on=DRT −2.5F; and heat off=time out.

The present invention is directed to a building temperature management system incorporating the following:

1. A direct-fired forced air variable rate convection heater;
2. A room controller with on/off heat control capability; and
3. The room controller manages ventilation in its normal fashion and the SmartBox manages the heat on a variable basis.

OR

1. A direct-fired forced air variable rate convection heater;
2. A room controller with one or more 0-10 vdc, 4-20 ma, or 0-20 ma heat control outputs when utilized with an appropriate control algorithm. A "Smart Sense" heater (discussed below) can utilize any of these inputs; and
3. The room controller manages ventilation in its normal fashion.

Exemplary Heaters

There are two basic types of heaters typically utilized in confinement housing: (1) conventional direct-fired forced-air convection heaters and (2) high intensity radiant heaters. Both the forced-air heater and the radiant heater are auto-ignition products. A relay would be necessary to turn the heater on and off. As long as there is a need for heat, the relay is closed.

A representative direct-fired forced-air convection heater is sold by L.B. White (Onalaska, Wis.) under the trademark Guardian™. The Guardian™ AW100 model is referenced by U.S. Pat. No. 6,360,955 to Hoff et al. Forced-air heaters are offered in hot surface ignition and direct spark ignition configurations. The Guardian™ AW250, AW100, and AW060 models are examples of hot surface ignitions configurations. The Guardian™ AD250, AD100, and AD060 models are examples of direct spark ignition configurations. These heaters incorporate a manually adjustable valve that can be used to reduce firing rate. In this manner, the valve is simply a one-quarter turn on/off valve with a by-pass opening drilled through it to establish the minimum firing position. The disadvantages of this approach are that the valve requires operator intervention, i.e. it is not automatic, to adjust the valve when heat demand varies significantly and additionally that it does not provide the broadest possible range of variable heating. For the Guardian™ AW100 model, the range is 50-100,000 British Thermal Units per hour ("Btuh"). For the AW/AD 250 model the range is 160-250,000 Btuh.

An example of a high intensity radiant brooder product line is an L.B. White Infraconic® radiant heater (see http://www.lbwhite.com/products/Swine-Heaters/Infraconic-Radiant-Heaters). This product is a 10-100% variable rate heater. It is typically controlled by a manual thermostatic control system identified as the zone control panel.

One issue of the radiant brooder product line is that it is a manual system requiring intervention by workers to reset temperatures during the production cycle. In addition, the system is sensitive to location of the sensor probe. U.S. Pat. No. 5,060,629 covers the basic design of this system, and U.S. Pat. No. 5,549,099 covers a dual orifice version of this system.

L.B. White Guardian™ series direct-fired forced air convection heaters are known in the industry as having a "bent-flame" design. Air flow moves through the heater as well as the flame, with the heated air being directly discharged from the heater. Gas pressure supplied to the burner orifice determines the firing rate. The conventional Guardian heater is a manually-adjustable variable rate heater over a defined range. For gas management, the system incorporates a combination safety gas control valve; two solenoid, i.e. redundant shut-offs; a pressure regulator that is at a fixed setting, i.e. the outlet pressure out of the gas control valve is constant; a pipe conduit conducting gas flow from the outlet of the combination safety gas control valve to the inlet to a manually adjustable ball valve with a by-pass hole through the "closed" side. The size of the by-pass hole determines the minimum flow through the valve. With this by-pass hole the heat can be manually varied from a minimum output to full output. For the "250" model of the product, the minimum is 65% of full rate. For the "100" and "60" models of the product the minimum is 50% of full rate. A pipe conduit conducts gas flow from the outlet of the manually adjustable ball valve to the inlet of the burner orifice. For the Guardian™ Smart Sense™ variable rate heaters, a combination safety gas control valve with an electronically adjustable pressure regulator is utilized. The pressure regulator is adjusted based on input signal received from the control means. The operation range is from 25% of rate to 100% of rate. A pipe conduit conducts gas flow from the outlet of the electronically controlled gas control valve to the burner orifice.

There are two exemplary basic configurations of the Smart Sense™ variable rate heater. A first configuration is for use with the SmartBox™ system. This configuration is as described above with incorporation of the electronically variable gas control valve. A second configuration is for use with a control signal from a control means other than the SmartBox™. As described above with the incorporation of the electronically variable gas control valve, a signal conditioner board is added in to the electronics enclosure. This board can accept input signals of 4-20 ma or 0-20 ma directly. With a 0-10 vdc input signal a dropping resistor is used in series in order to establish essentially a 4-20 ma input to the board. The signal conditioner board in turn provides a 0-15 vdc 450 ma signal to the gas control valve.

Exemplary Control Logic/Control Algorithm

The control logic is generally referred to as Proportional+Integral ("PI" or "proportional-plus-integral") with a dead-band. Proportional-only control logic does not have the ability to "lock" in to a temperature. Addition of the integral function provides the ability to "lock" in to a specific temperature. Total error correction is the combination of proportional area and integral correction:

$$E_c=E_p+E_I$$

As actual temperature approaches the desired temperature, the proportional correction decreases and the integral correction increases resulting in the precise correction needed to maintain the desired temperature. $E_p$ is conventional reverse-acting control logic:

$$E_p=(H_{SP}-T_{actual})T_r$$

where:

$T_{actual}$ is the sensed air temperature;

$H_{SP}$ is the desired Heating Setpoint temperature;

$T_r$ is typically defined as the throttle range or operating range of the control element, the temperature spread that covers the control output from min output to maximum output.

$E_I$ is a conventional integral calculation; the sum of the error corrections made at discrete time increments over a defined period of time:

$$E_I=\int_0^{Ti} e(t)dt$$

where:

Ti here represents time in seconds;

$e=T_{actual}-H_{SP}$ at a specific point in time.

When actual temperature is within a specified range (referred to as the "dead band") of the Heating Setpoint temperature, then no error correction is taken—that is, error correction is held at its last value until such time as temperature falls outside of the dead-band and a new correction is required.

Hardware input in to the control logic is the temperature sensor(s) that reflect room air temperature or in the case of brooders the radiant heat temperature. Parameters specified for the control logic are: (1) Heating Set Point temperature; (2) starting temperature=Heating Setpoint−0.5F; (3) dead-band=0.1F; (4) throttle or operating range; (5) integral time; and (6) operating range (i.e., minimum percent of output and maximum percent of output); (7) time-out time. An Object of the invention is to achieve a precise temperature. A heating on point 0.5° F. below Heating Setpoint is utilized to minimize temperature drop in the room before heating is activated. A 0.1° F. dead-band is utilized to achieve a precise, stable temperature.

The application of the basic PI control logic to variable rate heating is applied as follows. At Heating Set Point −0.5F, error correction commences. Error correction continues until actual temperature is within 0.1F of desired Heating Set Point. When actual temperature is within 0.1F of desired heating set point then the error correction output is maintained at its last value. When actual temperature falls outside of 0.1F of desired heating set point then the error correction resumes; either increasing or decreasing heat dependent on the error correction value. If error correction reduces to minimum output and stays at that level for (for example) 90 seconds then the heating is shutoff. Heating starts again when actual temperature drops below Heating Setpoint 0.5F.

Consequently, while there may be an "on" temperature (such as Heating Sepoint minus 0.5F)), there is not a predefined "off" temperature. An object of the present invention is to achieve consistent air temperature throughout the room by extending the heater run time thereby making the heater an integral part of the room air mixing and distribution system. With a 'heat to demand' variable rate heating system this happens naturally since by providing only the amount of heat necessary to achieve and maintain the Heating Setpoint temperature the heater operates much longer. The variable rate heater has a defined operating range—from minimum to maximum output where minimum output is greater than 'zero'. With this a situation can occur where the control correction has reduced the heater to its minimum output and this output is higher than needed—i.e. the temperature is above the +dead-band and cannot be further reduced. With the Objects of extending heater run-time but yet not allow the heating to cause the air temperature to exceed DRT and cause ventilation to activate a time-out feature is utilized. Ref Fig X. For example, the heat may is turned off when (1) the heater has been at its minimum output level for a given time period (such as 90 seconds), while (2) the detected temperature has been at least as great as the "on" temperature (here, set point minus 0.5F). The user determines and inputs the time period to be utilized based on selection of the Heating Setpoint and DRT as well as the building heat loss/gain response.

Exemplary Operation of the System

As an example of the operation of the current system, the system can include a L.B. White automatic variable rate direct-fired forced air convection agricultural heating system consisting of a number of elements. An L.B. White Guardian™ Smart Sense series direct-fired forced air convection heater for heating the interior of animal confinement buildings includes a support enclosure which contains a gas burner including a gas system with a combination gas control valve incorporating dual shut-off solenoids and an electronic modulating pressure regulator controlling the output pressure from the gas valve over a defined range based on a control signal input. The gas system terminates in an appropriately sized burner orifice and incorporates necessary piping and connections.

The heating system also includes an ignition system to ignite gas and start the combustion process. This can be a hot surface ignition system or, in the alternative, a spark ignition system. In the case of hot surface ignition, it can include a relay that withholds the control signal from the gas control valve as the heater goes through the pre-purge and ignition sequence. The ignition system incorporates an ignition control with safety monitoring logic in conjunction with air proving and temperature limit switches. The heating system also includes a heat chamber to capture and direct the combustion flame as well as a fan and motor assembly, incorporated into a fan housing assembly that pulls air into the enclosure from outside. The air is mixed with the combustion flame to dilute the flame temperature to a maximum of 350 ROA ("Rise over Ambient"), with the diluted air mixture then being discharged into the facility to be heated.

Exemplary System Number 1

Figure 3:
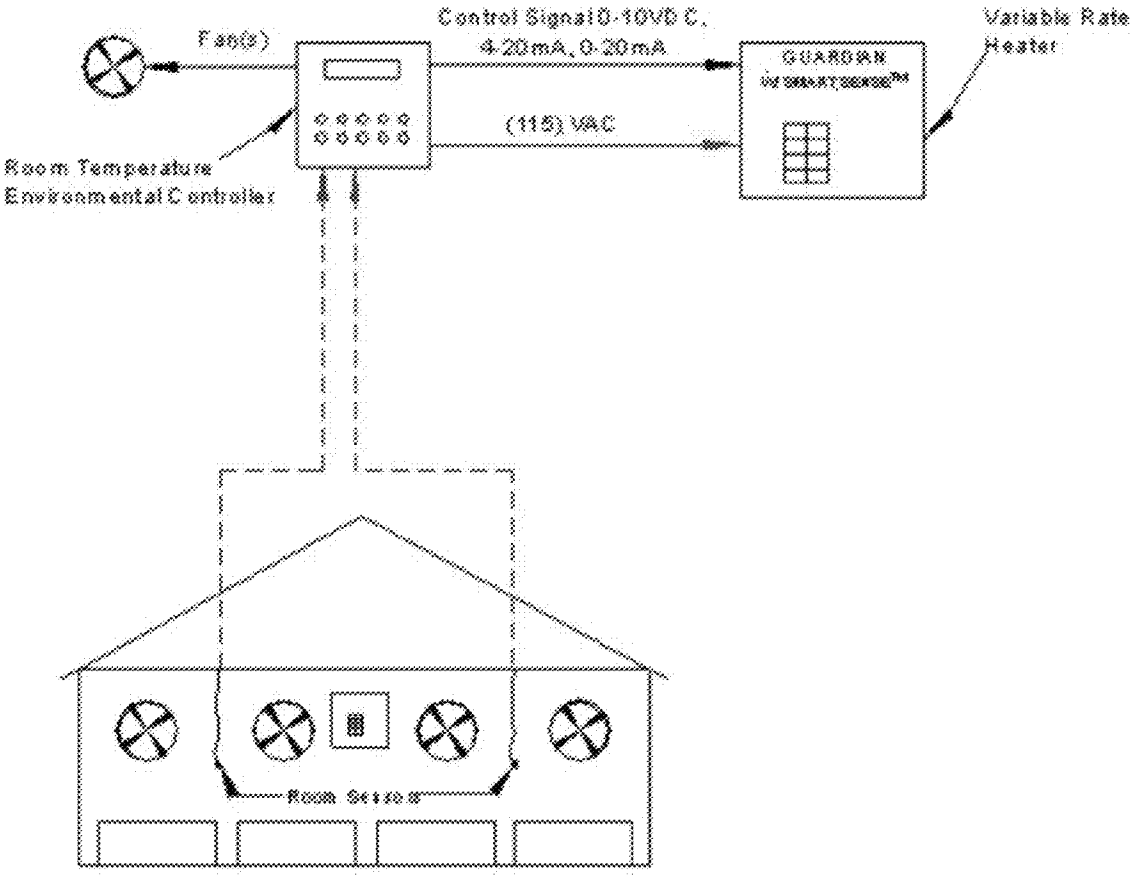
FIG. 3 is a representation of a first exemplary temperature control system using variable rate heating. The control incorporates appropriate heat control logic and provides heat control output of either 0-10 vdc, 4-20 ma, or 0-20 ma to the Smart Sense variable rate heater. Ventilation fans are controlled by the room control in a conventional manner.

See FIG. 3

In a first alternative system, a direct-fire forced air convection heater for heating the interior of animal confinement buildings, as described above incorporates a signal conditioner that receives a 0-10 vdc, 4-20 ma, or 0-20 ma control signal from a room temperature environmental controller that is the driver signal for the electronic modulating pressure regulator. The room temperature environmental controller incorporates the following features and characteristics:

1) A room temperature environmental controller for animal confinement buildings that manages room temperature based on user-programmable Heating Setpoint and DRT ventilation temperatures;
2) One or more temperature sensors located in the room to provide measurement of the actual room air temperature;
3) In the case of multiple sensors, the sensors are averaged to give an average room temperature reading for control purposes;
4) Incorporates a user-programmable temperature curve, i.e., days and temperatures, linearly ramping from one set point to the next;
5) Manages minimum ventilation for proper indoor air quality, i.e., can be either timer-based or continuous at a defined level;
6) Manages overall temperature ventilation/cooling of the building with one or more stages of variable fans and one or more stages of fixed speed fans;
7) Ventilation air flow increases when average temperature increases over the specified set-point temperature by a user-defined amount, i.e., stages of ventilation are activated based on the average room temperature over the specified set-point temperature by a user-defined amount specific to each stage of cooling;
8) Manages heat by providing a (for example) 0-10 volts direct current ("vdc") control signal to the variable rate forced air heater by a Proportional+Integral Control Logic with the following characteristics:
   a) P-Only Control
   i) Depends on present error, the error at a point in time.
   ii) Has no historical basis nor any future rate of change basis
   iii) By definition it cannot 'lock' to a specific target temperature—when the proportional error is equal to zero there is no mechanism to hold it at that level.
   iv) Typically results in a non-correctable offset from the desired temperature. The average variation in temperature is lower than the desired target temperature
   v) Basic Equation:
      (1) Pout=Kp e(t)
      (2) Kp is the proportional gain
         (a) A high proportional gain, i.e. large change in output for small error can become an unstable system
         (b) A low proportional gain, i.e. a small change in output for a large error can result in slow response and less sensitive control
   vi) Typical version
      (1) For air temperature heating situations a reverse-acting proportional correction is used—the output increases as actual temperature falls below set point. The error becomes $e(t)=H_{SP}-T_{ACT}$ where $H_{SP}$ is the desired Heating Setpoint temperature and $T_{ACT}$ is the measured room temperature at a point in time.
         NOTE: $H_{SP}$ is user-adjustable based on the operator's understanding of the room operation. It can be set as close as −0.5F to DRT but more typically can be 1-2F or more below DRT.
   vii) Most control devices have a range of operation:
      (1) For a minimum input signal an equivalent minimum output signal
      (2) For a maximum input signal an equivalent maximum output signal
      (3) As examples
         (a) With a 0-10 vdc control signal a particular control device may require 1 vdc as the minimum output signal and 8 vdc as the maximum output signal (b) With a 4-20 ma control signal a particular control device may require 4 ma as the minimum output signal and 16 ma as the maximum control signal (4) $T_{OPR}$ is defined as the change in measured temperature required to change the output from its minimum position to its maximum position. As an example, a $T_{opr}$ of 8F means it takes 8 degrees of temperature change to get the device output from its minimum output to its maximum output.

viii) Kp then becomes a proportional band expressed as $(1\times T_{opr})$ ix) Combining the elements together a reverse acting proportional control output at a point in time is represented as: $P_{out}=(1\times T_{opr})\times(H_{SP}-T_{ACT})$ b) Integral Control i) The I element (integral) is the accumulation of past errors ii) It is used in conjunction with proportional control to correct the deficiencies of 'P' control (1) Can 'lock' to the desired temperature and eliminate the offset (2) The proportional correction can become zero but there is still a residual integral correction which is the factor that keeps the temperature 'locked' on set point.

iii) When combined with 'P' control as the actual temperature approaches the desired temperature the proportional correction decreases in size and the integral correction increases in size (1) $I_{out}=(Kc\div Ti)\int e(t)dt$ (2) Kc=system gain (3) Ti=integration time. The amount of time over which the integration occurs. At the end of that the integration calculation value resets to zero and the restarts from integration time zero (4) e(t)=current error at time t iv) When combing 'P' and 'I' control elements together it is understood that the 'P' factor should contribute the bulk of the output change. Therefore the element $(Kc/T_i)$ in the equation becomes small v) The basic equation, incorporating reverse acting error and $K_c=K_p$, then becomes (1) $I_{out}=(Kp\div T_i)\times\int(Hsp-Tact)dt$ (2) Substituting $Kp=(1\div T_{opr})$ yields (3) $I_{out}=((1\div(T_{opr}\times T_i))\times\int(Hsp-Tact)dt$ (4) In this equation $T_{opr}$ and $T_i$ interact with each and therefore 'tuning' of the installed system is required (a) For air heating $T_i$ values in the range of 400-600 seconds are typical for air heating (b) When $T_{opr}$ is combined with $T_i$ the range 6-8F for $T_{opr}$ is typical 9) Correction signal is based on error (control temp−actual temp);

10) The operating or throttle range is the sensitivity factor for the proportional control calculation. The larger the range the smaller the correction. The correction signal is divided by the operating or throttle range;

11) Incorporates a dead-band, typically 0.1F;

12) Incorporates a user specified time-out feature. When there is still a call for heat and the heat output has been at minimum for X seconds, typically 90 seconds but can be longer or less depending on room characteristics, then the heater is shut off.

13) Can assign the room air temperature sensors to establish the measured room temperature. In the case of multiple sensors, the average room air temperature is determined;

14) Incorporates an AC power relay that transfers electrical power to the heating system, which is assignable user-adjustable Start Temps and Stop Temps, which is the same as done with on/off heating.

NOTE: Room temperature environmental controllers presently available in the USA market with 0-10 vdc output signals for heat control do not work as described above.

Exemplary System Number 2

Figure 4:
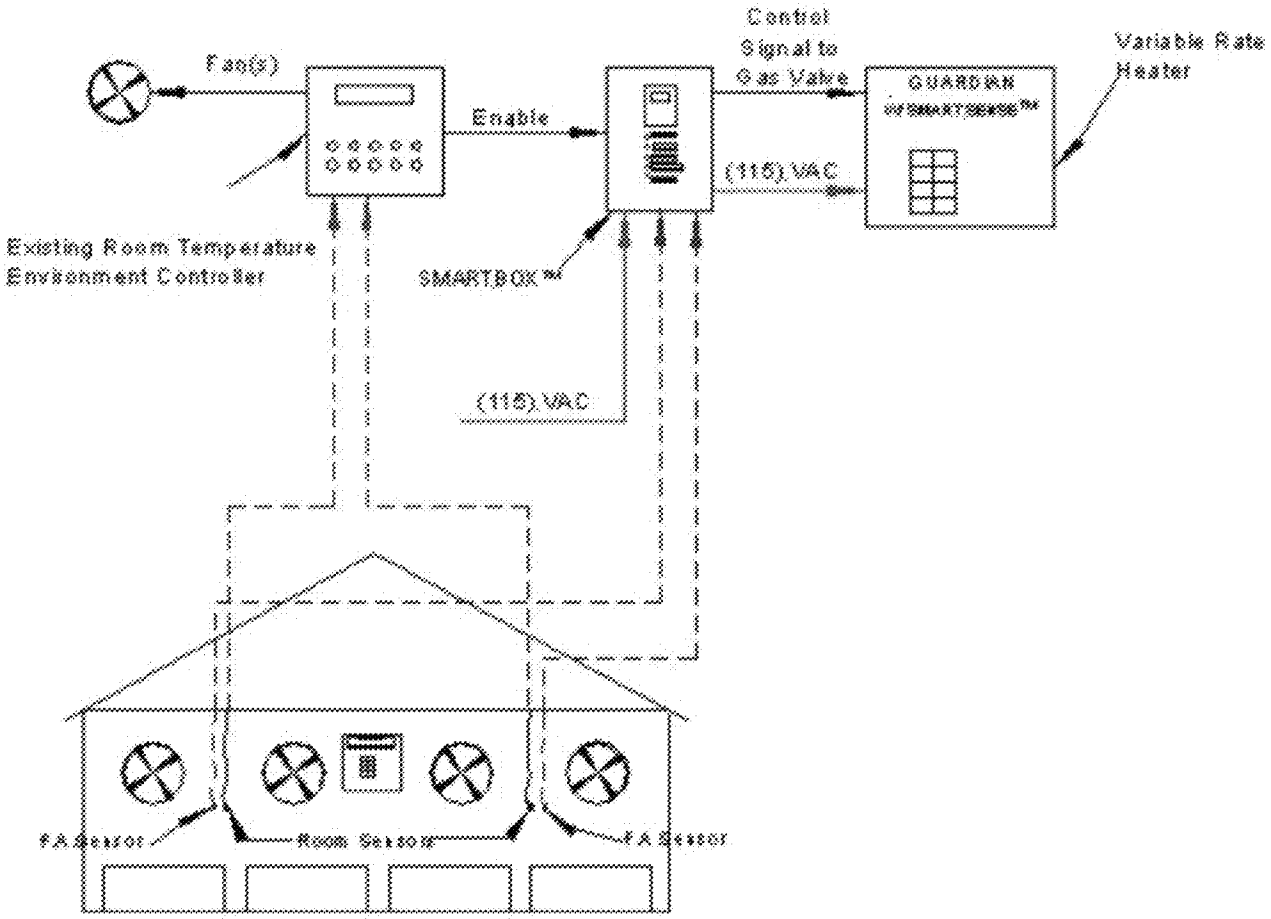
FIG. 4 is a representation of a second exemplary temperature control system with variable rate heating and forced air. Ventilation fans are controlled by the room control in a conventional manner. The SmartBox controls the Smart Sense variable rate forced air heater. The conventional room control on/off relay serves as the digital enable to allow the SmartBox to control heat. SmartBox temperature sensors are co-located in the room with the existing room control temperature sensors. The SmartBox utilizes appropriate control logic and supplies a 0-15 vdc control signal to the Smart Sense heater gas control valve.

See FIG. 4

A second system illustrates a Guardian™ series direct-fired space heater for heating the interior of animal confinement buildings, as described above, in conjunction with a room temperature environmental control that provides an AC power relay that places heating in either the "on" or "off" positions, in conjunction with an auxiliary temperature controller, i.e., the SmartBox technology.

The room temperature environmental controller incorporates the following features and characteristics:

1) A room temperature environmental controller for animal confinement buildings that manages room temperature to a user-programmable set point temperature;

2) One or more temperature sensors are located in the room to provide measurement of the actual room air temperature;

3) In the case of multiple sensors the sensors are averaged to give an average room temperature reading for control purposes;

4) Incorporates a user-programmable temperature curve i) Days and temperatures, linearly ramping from one set point to the next 5) Manages minimum ventilation for proper indoor air quality i) Can be either timer-based or continuous at a defined level 6) Manages overall temperature ventilation/cooling of the building with i) One or more stages of variable fans ii) One or more stages of fixed speed fans 7) Ventilation air flow increases when average temperature increases over the specified set-point temperature by a user-defined amount i) Stages of ventilation are activated based on the average room temperature over the specified set-point temperature by a user-defined amount specific to each stage of cooling.

8) Manages heating by turning the heater on or off via. an AC power relay i) Assignable user-adjustable Start and Stop Temperatures relative to set-point ii) Start and Stop temperatures can be offset from set-point as a user-adjustable parameter.

The auxiliary temperature controller incorporates the following features and characteristics:

SmartBox Technology Hardware

1) National Electrical Manufacturers Association (NEMA) 4-x enclosure

2) Contains:

i) Programmable logic controller (such as the Honeywell Spyder® Controller—see, e.g., http://customer.honeywell.com/BuildingsMarketing/Cultures/en-US/Automation+Systems/SpyderController/and http://beyondinnovation.honeywell.com/products/spyder)

ii) Touch-pad operator interface panel (such as the Honeywell Zio™ LCD Wall Module see, e.g., http://customer.honeywell.com/BuildingsMarketing/Cultures/en-US/Components/Zio/)

(1) To monitor overall function of the control—temperature per zone, set points, etc.

(2) To program in the temperature curve—days and temperature settings.

iii) Signal condition boards, two, to drive gas controls in each zone.

(1) Signal conditioner board for the Honeywell valve takes 4-20 ma input signal and converts to 0-15 vdc signal (2) Signal conditioner board for the radiant brooders takes 4-20 ma input signal and converts to a 24 volt PWM (pulse width modulated) signal to control the zone gas control valve.

iv) Two relays, one for each control zone, to provide AC power to each control zone as needed v) Indicator lights (1) Two green lights—indicate when the heating zone is on; Zone 1 and Zone 2

(2) Orange Cycle Complete—indicates when the control is gone through its programmed temperature curve (3) Red—sensor failure. Indicates when one of the input sensor thermocouples has failed. Can be diagnosed by using the touch-pad.

vi) A toggle switch to facilitate resetting the control back to day 1 in the temperature curve after the temperature curve is completed.

vii) Terminal strip associated wiring to connect various components together.

viii) Two 24 vac power transformers. One providing power to the Honeywell Spyder control board and one providing power to Elan Industries signal conditioner boards and to Elan's signal conditioner with PWM outputs. See, e.g.: http://www.elanindustries.com/products/Spec %20Sheet %20-%200-15 vdc.pdf; http://www.elanindustries.com/pdf/Elan-SignalConditioners.pdf; and http://www.elanindustries.com/products/Spec %20Sheet %20-%20 PWM %20Signal %20Conditioner.pdf.

Figure 9:
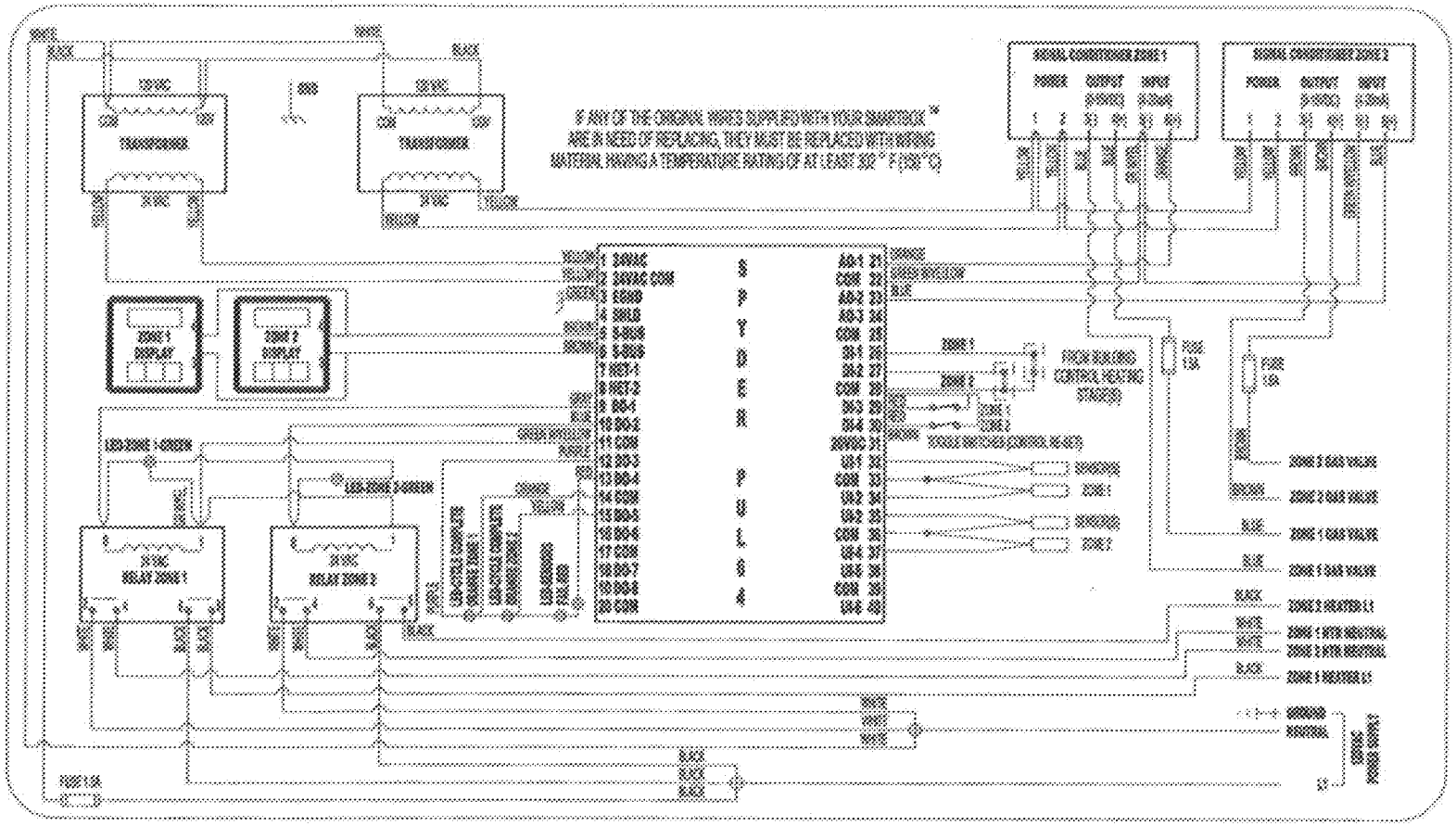
FIG. 9 is a wiring diagram of an exemplary SmartBox.
Figure 10B:
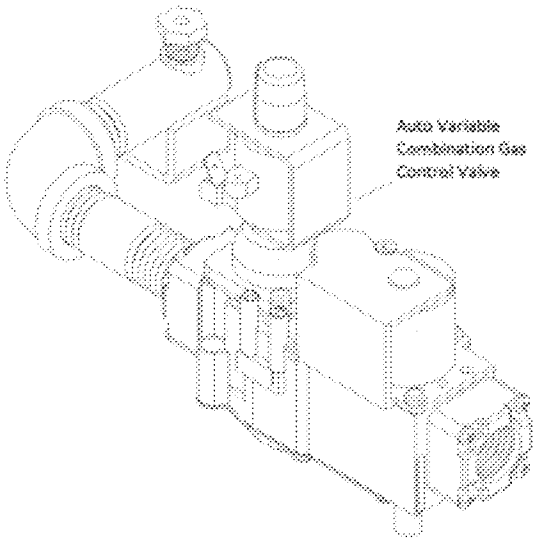
FIG. 10B depicts an exemplary system with auto variable combination gas control valve.
Figure 10A:
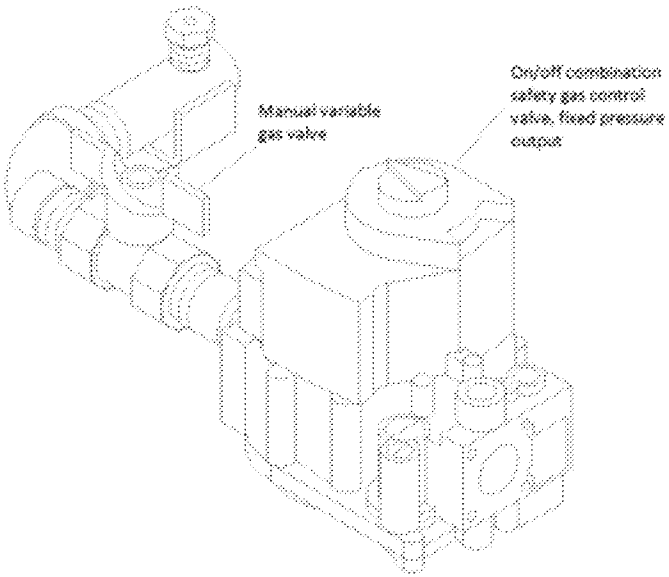
FIGURE 10A PRIOR ART
FIG. 10A depicts a prior art system with a manual variable gas valve and an on/off combination safety gas control valve with fixed pressure output (such as used in the Guardian™ AW100, discussed below).

Reference is made to FIG. 9 for the wiring diagram for a forced air version of the SmartBox technology.

Control Program

1) PI (Proportional, Integral) control logic

2) Heating temperature Setpoints are defined via. the touch-pad

3) Start temperature is 0.5F below Setpoint a. A dead-band feature is utilized—the control does not take action if the measured temperature is within 0.1 F of the desired set point temperature.

4) 4-20 ma output signals: one per zone

5) For the off function uses a time-out feature. If the output sits at the minimum position for 90 seconds without needing to increase from minimum the temperature requirement is considered to be satisfied and the control times out.

6) Two zones of heat control a. Can be two zones for forced air heating b. Can be two zones for radiant heating c. Can be one zone of forced air heating and one zone of radiant heating (up to four sensors may be used for the forced air zone and one sensor for the radiant brooder zone)

7) Temperature reference input a. For forced air heating two temperature sensors (20 k NTC Thermistor) are co-located with room temperature sensors for the existing room controller b. The software algorithm reads the two sensors and determines the average—this average room temperature then becomes the temperature reference for comparison to the desired set-point. For radiant heating a single temperature sensor (20 k NTC Thermistor) is mounted off of one radiant brooder in the heat control zone. The location of the sensor on the brooder has been determined to represent the average temperature of the radiant heated floor area as a combination of radiant heat from the heater and convection heat from the heated floor. This becomes the temperature reference for the radiant heated zone.

8) Each zone is programmed with up to ten-temperature event cycle.

a. Temperature and days are defined b. Program linearly ramps from one temperature/day combination to the next day/temperature combination i. A real-time clock is incorporated.

9) For controlling forced air heating it is necessary that the heat and ventilation work together properly a. There is a software enable that allows the control algorithm to function i. Use a relay closure from the existing room controller, the on/off power relay, that provides a digital enable to the program with contact closure.

ii. This software enable feature isn't required for the radiant control version.

As a further example of operation of the system, the system can include the L. B. White automatic variable rate direct-fired forced air convection agricultural heater as previously described in conjunction with the Infraconic variable rate heater. The Infraconic variable rate heater will be installed in a zone (multiple heaters located throughout the room) to provide patterns of radiant heat at the animal level. The Infraconic radiant brooder can be either a manual ignition configuration or an automatic electronic ignition configuration. Gas flow to the zone will be controlled by a proportional solenoid control valve such as the ASCO Posiflow Proportional Solenoid Series 8202/8203 valves. In addition, some installations may require a signal conditioner such as the ASCO Electronic Control Unit Series 8908. See, e.g., http://www.ascovalve-.com/Common/PDFFiles/Product/PosiflowR3.pdf.

Exemplary System Number 3

Figure 5:
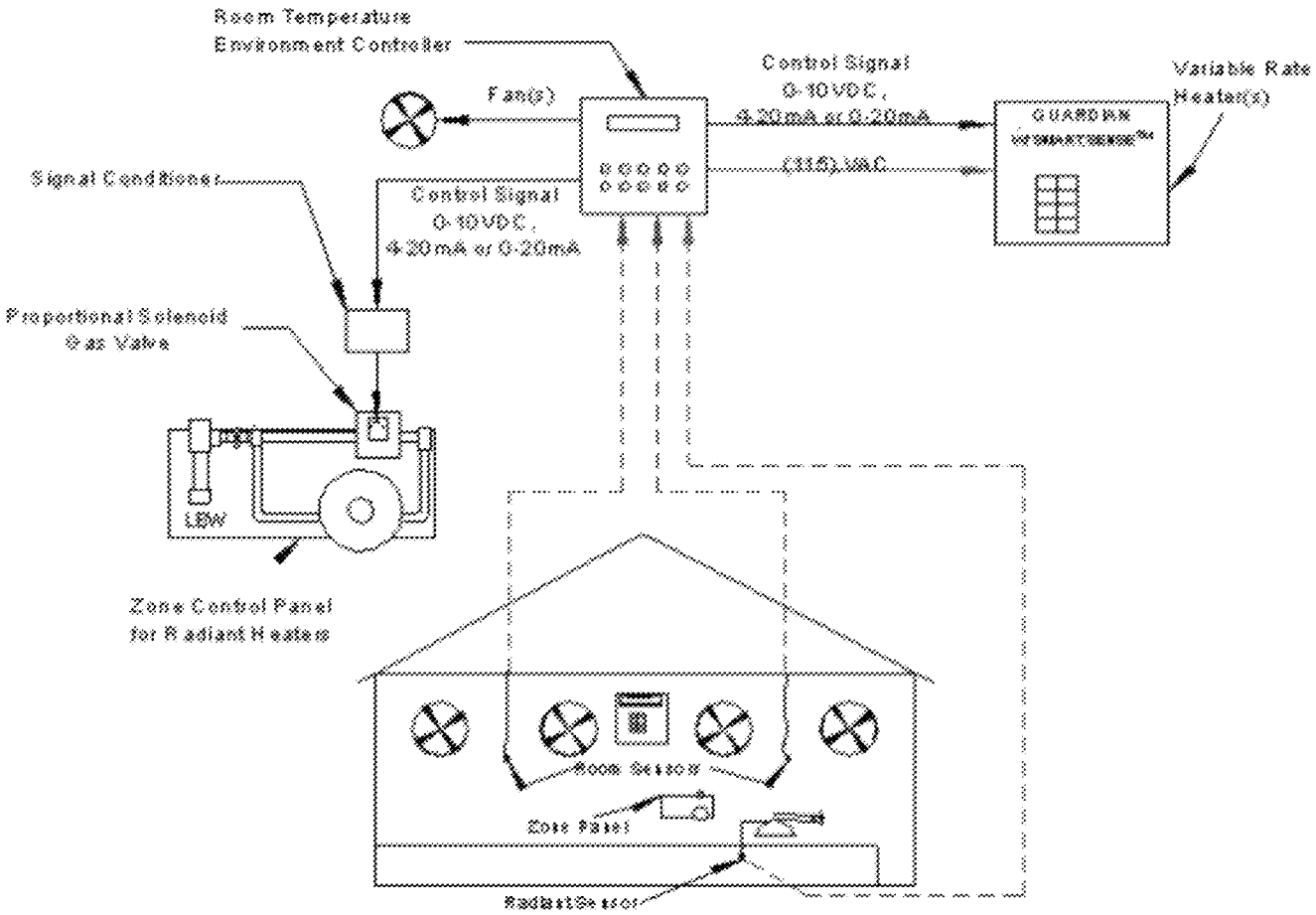
FIG. 5 is a representation of a third exemplary temperature control system with forced-air and radiant heaters. Ventilation Fans are controlled by the existing room control with existing logic. A Smart Sense variable rate forced air heater is controlled by room controller with appropriate logic. Control output options include a 0-10 vdc output signal, a 4-20 ma output signal, or a 0-20 ma output signal. The Smart Sense Infraconic® variable rate brooders are controlled by the room controller with appropriate logic. The system includes: (1) the variable rate manual or spark ignition brooder; (2) a temperature sensor holder mounted on the heater (the sensor holder shape and location is designed to represent the average heated-area temperature based on a combination of radiant heating from the brooder and convection heat from the air); (4) A temperature sensor installed within the holder that is connected to the room control as a separate temperature input; and (5) a zone panel that includes: a) a low-pressure by-pass regulator to provide the minimum level gas flow; b) a proportional solenoid gas control valve that provides the gas flow to the brooder as necessary over the operating range from minimum to full-output; and c) a signal conditioner attached to the proportional control valve that accepts either 0-10 vdc, 4-20 ma or 0-20 ma control signals and then provides proper signal to the proportional control valve.

See FIG. 5

A third alternative system of a direct-fired forced air convection heater for heating the interior of the building as identified in System Number 1 and System Number 2 now includes one or more zones of the Infraconic variable rate brooder. Each zone incorporates an ASCO proportional solenoid control valve and one sensor located on a radiant brooder. In addition to the ASCO Posiflow proportional solenoid control valve the ASCO Electronic Control Unit is incorporated. The room temperature environmental controller incorporates the features characteristics as described in System Number 1 as well as the following additional features and characteristics.

1) Provision for an additional temperature sensor input specifically assigned to the radiant heat animal occupied zone. This sensor input becomes the temperature reference for the radiant heat animal occupied zone.

2) The ability to set the radiant animal occupied zone control temperature above the room temperature by a user-defined amount.

3) The ability to have the radiant heat temperature control point 'track' with the room temperature set-point. For example, if the room temperature set point is decreased by 1 degree Fahrenheit then the radiant heat temperature control point is decreased 1 degree Fahrenheit as well.
4) The Proportional+Integral with dead-band control logic as discussed in System Number 2. Typically $T_{OPR}$ is 4-6 F and $T_I$ is 200-300 seconds.

Exemplary System Number 4

Figure 6:
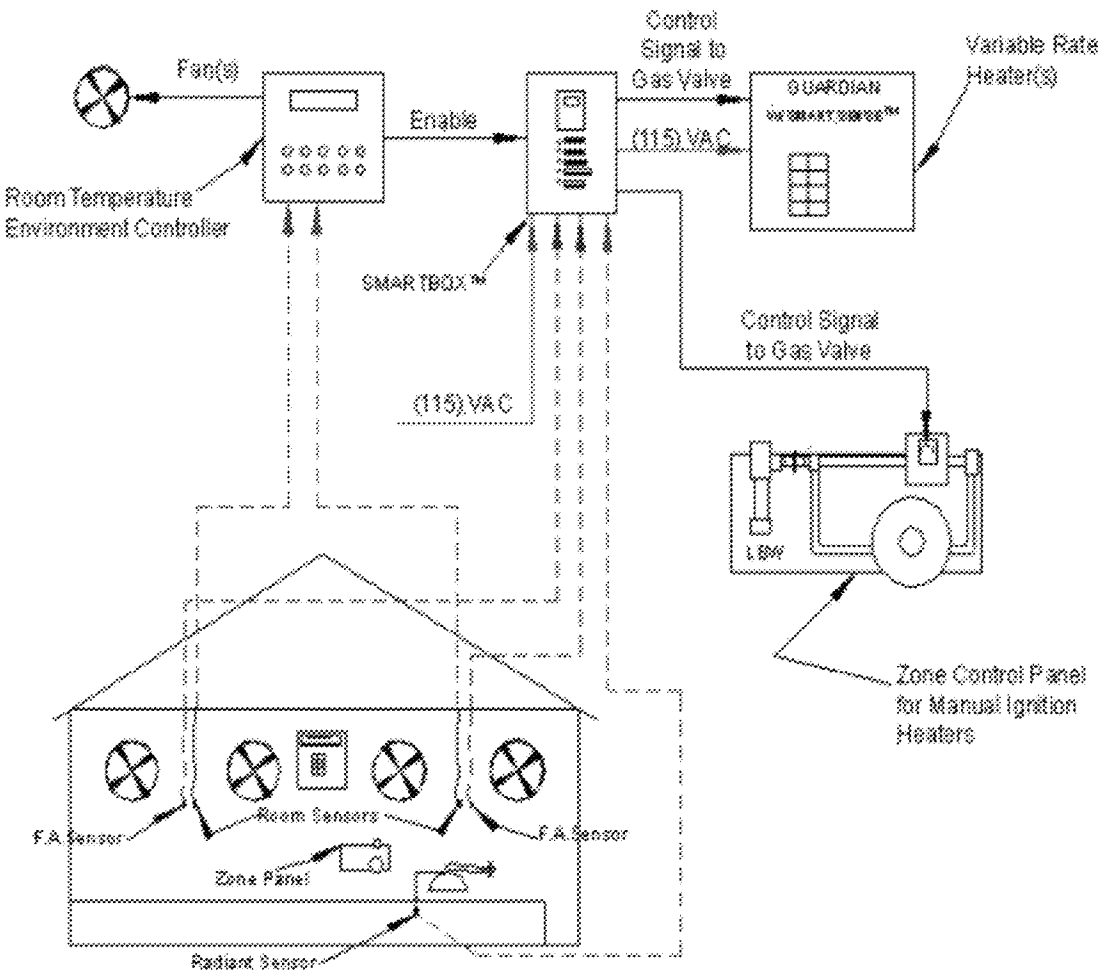
FIG. 6 is a representation of a fourth exemplary temperature control system. Ventilation fans are controlled by the existing room control in the conventional manner. A SmartBox is used to control Smart Sense variable rate forced air heater. A conventional room control on/off relay serves as the digital enable to allow the SmartBox to be engaged. SmartBox temperature sensors are co-located in the room with the existing room control temperature sensors. SmartBox utilizes appropriate control logic and supplies a 0-15 vdc control signal to the Smart Sense heater gas control valve. The SmartBox is also used to control Smart Sense Infraconic variable rate brooders. This system includes: (1) the variable rate manual or spark ignition brooder; (2) a temperature sensor holder mounted on the heater (the sensor holder shape and location is designed to represent the average heated-area temperature based on a combination of radiant heating from the brooder and convection heat from the air); (3) a temperature sensor installed within the holder that is connected to the SmartBox; and (4) a zone panel that consists of (1) low-pressure by-pass regulator to provide the minimum level gas flow; and (2) a proportional solenoid gas control valve that provides the gas flow to the brooder as necessary over the operating range from minimum to full-output. The SmartBox utilizes appropriate control logic and supplies a 24 volt PWM (pulse width modulated) control signal to the proportional solenoid gas control valve.
Figure 7:
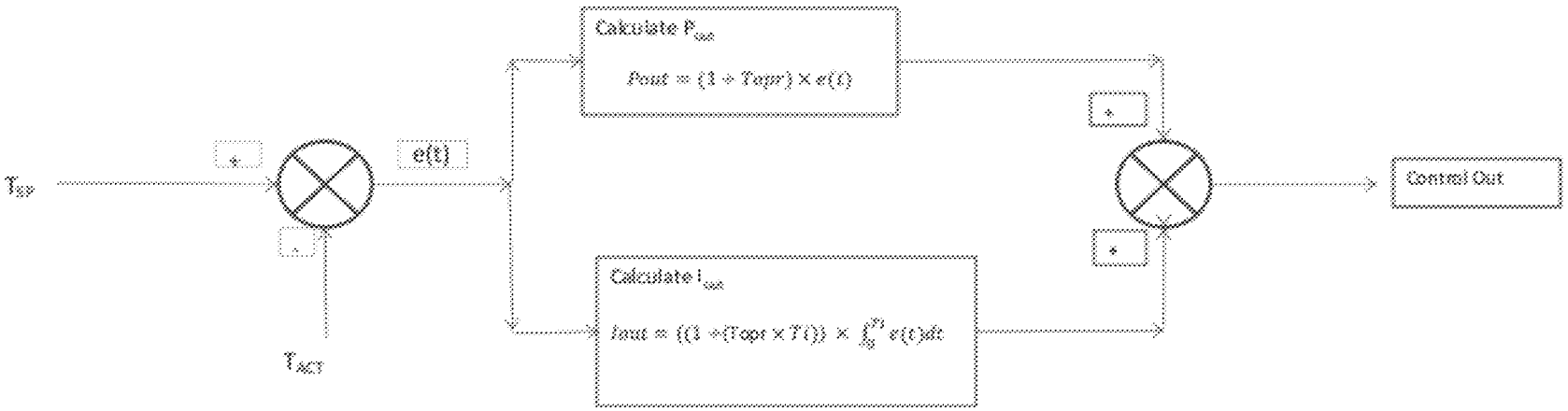
FIG. 7 is a representation of the conventional PI (Proportional+Integral) Reverse Acting Control Loop for Purposes of Air Heating. In the PI control algorithm depicted, $P_{out}$=Proportional Correction; $I_{out}$=Integral Correction; $H_{SP}$=Desired temperature (Heating Setpoint; $T_{ACT}$=Measured temperature; e (t)=($H_{SP}$−$T_{ACT}$) at a specific point in time; $T_{opr}$=Tmax−Tmin; and $T_i$=Integration time interval.
Figure 8A:
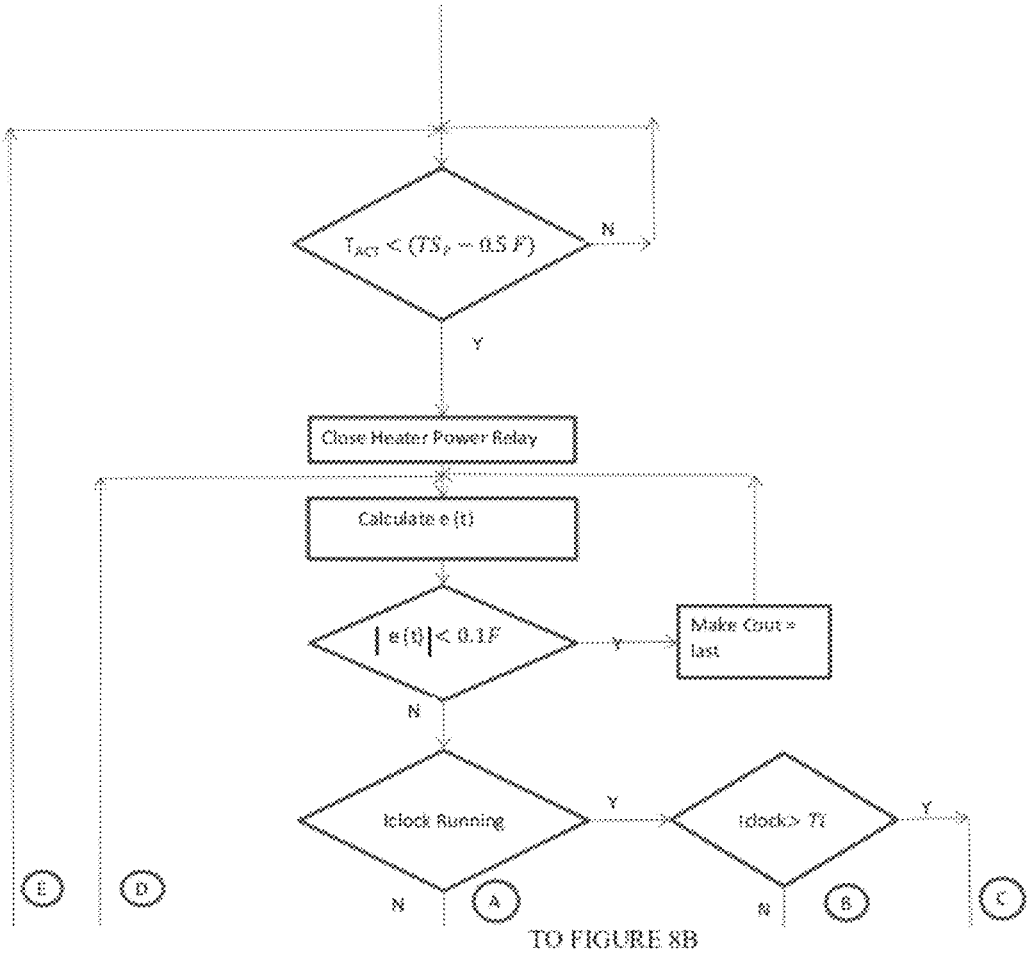
FIGS. 8A and 8B represent an application specific animal confinement building heating PI control loop with dead-band, defined start, and time out features. Input parameters include $H_{SP}$, $T_{OPR}$, $T_I$, Min position output, Max position output, and $T_{out}$. Measured (input) values include $T_{ACT}$, and calculated values include e(t), $P_{out}$, $I_{out}$, and $C_{out}$. $C_{OUT}$ controls the heat output of the heater between its minimum and maximum capability based on the calculations.
Figure 8B:
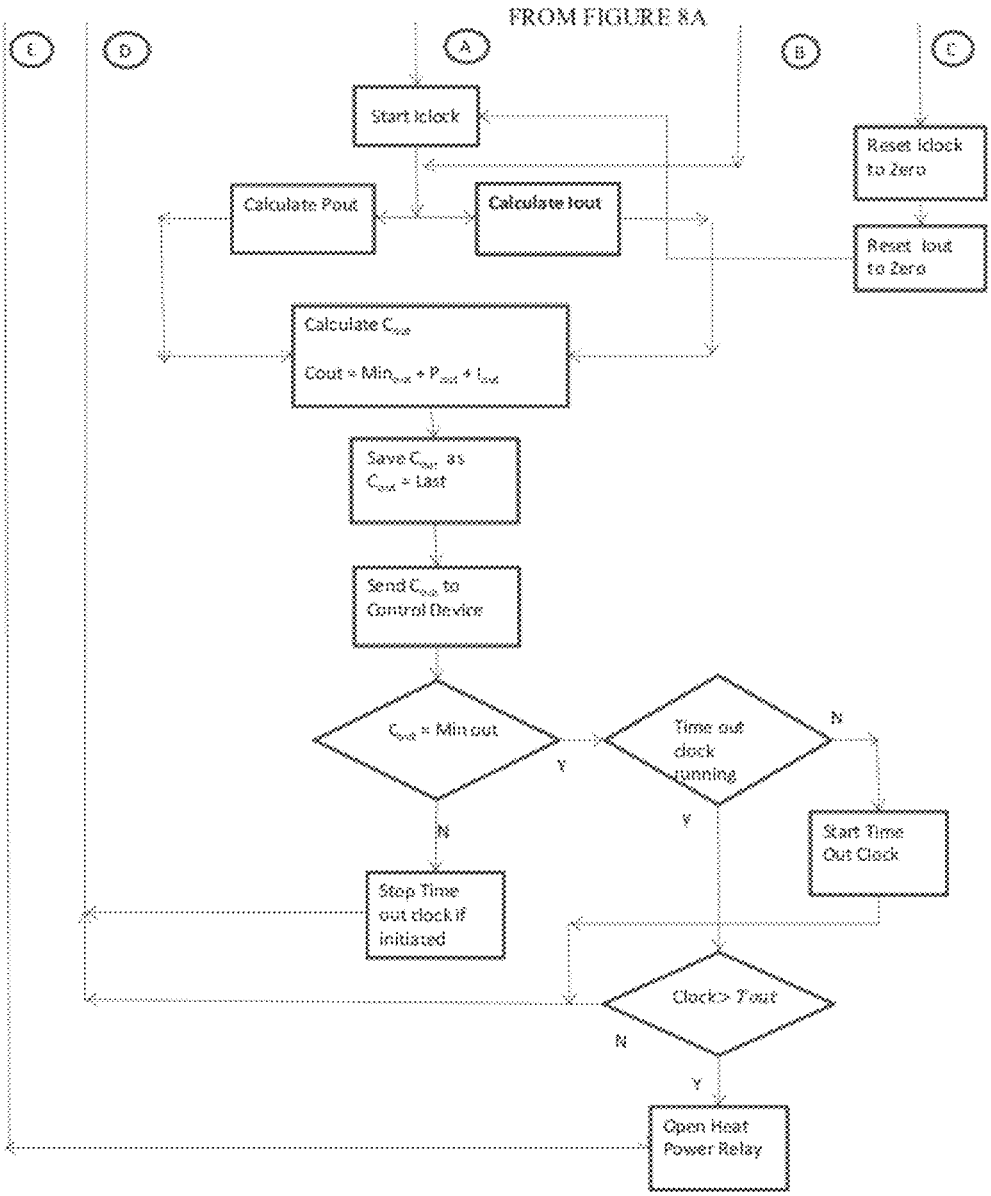

See FIG. 6

In a fourth alternative system a direct-fired space heater for heating the interior of the building as identified in System Number 1 and System Number 2 now includes one or more zones of the Infraconic variable rate brooder. Each zone incorporates an ASCO proportional solenoid control valve and one sensor located on a radiant brooder. The Room controller as previously defined in System Number 2 and the SmartBox control technology also as previously described in System Number 2.

To summarize some basic elements of above exemplary versions:

System Number 1 Includes:
a) A direct-fired forced air convection heater inclusive of an electronically controlled gas pressure regulator and a signal conditioner board to provide the drive signal to the gas control valve
b) A room temperature controller incorporating PI control logic with the capability to provide 0-10 vdc, 4-20 ma, or 0-20 ma control signal output to control the direct-fired space heater described above.

System Number 2 Includes:
a. A direct-fired space heater inclusive of an electronically controlled gas pressure regulator. b. A room temperature controller that manages heat in the on/off control mode
c. The SmartBox technology interface control.

System Number 3 Includes:
a) A direct-fired forced air convection heater inclusive of an electronically controlled gas pressure regulator and a signal conditioner board to provide the drive signal to the gas control valve
b) A room temperature controller incorporating PI control logic with the capability to provide 0-10 vdc, 4-20 ma, or 0-20 ma control signal outputs to control the direct-fired space heater described above.
c) One or more radiant heat control zones populated with multiple radiant heaters.
d) A temperature sensor for each radiant heat zone.
e) The gas supply to each zone being provided by a solenoid proportional control valve incorporating a driver module that receives its 0-10 vdc, 4-20 ma 0-20 ma control signal from
f) A room temperature controller with the capability to provide 0-10 vdc, 4-20 ma, or 0-20 ma control signal outputs to each radiant heat zone.

System Number 4 Includes:
a. A direct-fired space forced air convection heater inclusive of an electronically controlled gas pressure regulator. b. A room temperature controller that manages heat in the on/off control mode
c. The SmartBox technology interface control.
d. One or more radiant heat control zones populated with multiple radiant heaters.
e. A temperature sensor for each radiant heat zone.
f. The gas supply to each zone being provided by a solenoid proportional control valve.
g. The SmartBox technology interface control.

Other combinations beyond the four basic systems described above can also be constructed.

Any version of any component or method step of the invention may be used with any other component or method step of the invention. The elements described herein can be used in any combination whether explicitly described or not.

All combinations of method steps as used herein can be performed in any order, unless otherwise specified or clearly implied to the contrary by the context in which the referenced combination is made.

As used herein, the singular forms "a," "an," and "the" include plural referents unless the content clearly dictates otherwise.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

All patents, patent publications, and peer-reviewed publications (i.e., "references") cited herein are expressly incorporated by reference in their entirety to the same extent as if each individual reference were specifically and individually indicated as being incorporated by reference. In case of conflict between the present disclosure and the incorporated references, the present disclosure controls.

The devices, methods, compounds and compositions of the present invention can comprise, consist of, or consist essentially of the essential elements and limitations described herein, as well as any additional or optional steps, ingredients, components, or limitations described herein or otherwise useful in the art.

While this invention may be embodied in many forms, what are described in detail herein are specific versions of the invention. The present disclosure is an exemplification of the principles of the invention and is not intended to limit the invention to the particular versions illustrated. It is to be understood that this invention is not limited to the particular examples, process steps, and materials disclosed herein as such process steps and materials may vary. It is also to be understood that the terminology used herein is used for the purpose of describing particular versions only and is not intended to be limiting because the scope of the present invention will be defined by the appended claims and equivalents thereof.

What is claimed is:

1. A temperature control system for use in an animal confinement building,
(a) the temperature control system including:
(1) a variable rate heater which, when turned on, has a heat output ranging from a minimum heat output percent to a maximum heat output percent, the minimum heat output percent being smaller than the maximum heat output percent;
(2) a temperature sensor; and
(3) a controller for managing the variable rate heater and the heat output thereof;
(b) wherein:
(1) the system accepts a heat set point temperature from a user and measures a current temperature using the temperature sensor;

(2) the controller determines a difference between the current temperature and the heat set point temperature;

(3) while the difference is no greater than a dead-band value, the controller leaves the heat output of the variable rate heater unchanged at a current heat output;

(4) if the difference is greater than the dead-band value, the controller:

(A) determines an error correction based on both the difference and on one or more past error corrections, the one or more past error corrections having been determined based on one or more prior temperature readings; and (B) sets the heat output of the variable rate heater to an adjusted heat output based on the error correction, the adjusted heat output being:

(i) greater than the current heat output, up to the maximum heat output percent, if the current temperature is below the heat set point temperature; and (ii) lower than the current heat output, as low as the minimum heat output percent, if the current temperature is above the heat set point temperature; and (5) if the heat output of the variable rate heater remains at the minimum heat output percent without being adjusted upwards for a timeout period, the controller turns off the variable rate heater.

2. The system of claim 1 wherein the dead-band value is 0.1 degrees Fahrenheit.

3. The system of claim 1 wherein the timeout period is at least 90 seconds.

4. The system of claim 1 wherein the minimum heat output is no higher than 25%.

5. The system of claim 1 wherein the minimum heat output is between 0% and 50%.

6. The system of claim 1 wherein:

(a) the variable rate heater is a direct-fired forced air variable rate convection heater;

(b) the temperature control system further includes a variable rate radiant brooder, the variable rate radiant brooder also being managed by the controller; and (c) the system includes at least one temperature sensor that is located to facilitate sensing of radiant energy from the variable rate radiant brooder in combination with convection heat rising from the surface being heated by the variable rate convection heater.

7. The system of claim 1 wherein the controller:

(a) interfaces with a ventilation system to manage ventilation in the building; and (b) activates the ventilation system when the current room temperature exceeds a daily required temperature, the daily required temperature:

(1) having been input by a user; and (2) being higher than the heat set point temperature.

8. The system of claim 1 wherein:

(a) the temperature control system further includes a ventilation system managed by the controller; and (b) the controller activates the ventilation system if the current room temperature exceeds a daily required temperature, the daily required temperature:

(1) having been input by a user; and (2) being higher than the heat set point temperature.

9. The system of claim 1 wherein the error correction has:

(a) a proportional relationship with respect to the difference; and (b) an integral relationship with respect to one or more past errors.

10. The system of claim 1 wherein the error correction ("Ec") is the sum of:

(a) a proportional correction ("Ep"); and (b) an integral correction ("$E_I$").

11. The system of claim 10 wherein Ep=(Hsp−Tactual)/Tr, where:

(a) Tactual is sensed air temperature;

(b) Hsp is the heat set point temperature; and (c) Tr is the temperature spread.

12. The system of claim 10 wherein $E_I$ is an integral calculation involving the sum of the error corrections made at discrete time increments over a defined period of time.

13. A method of using a temperature control system in an animal confinement building, (a) the temperature control system including:

(1) a variable rate heater which, when turned on, has a heat output ranging from a minimum heat output percent to a maximum heat output percent, the minimum heat output percent being smaller than the maximum heat output percent;

(2) a temperature sensor; and (3) a controller for managing the variable rate heater and the heat output thereof;

(b) wherein the method includes the steps of:

(1) accepting a heat set point temperature from a user and measuring a current temperature using the temperature sensor;

(2) determining a difference between the current temperature and the heat set point temperature;

(3) leaving the heat output of the variable rate heater unchanged at a current heat output while the difference is no greater than a dead-band value;

(4) if the difference is greater than the dead-band value:

(A) determining an error correction based on both the difference and on one or more past error corrections, the one or more past error corrections having been determined based on one or more prior temperature readings; and (B) setting the heat output of the variable rate heater to an adjusted heat output based on the error correction, the adjusted heat output being:

(i) greater than the current heat output, up to the maximum heat output percent, if the current temperature is below the heat set point temperature; and (ii) lower than the current heat output, as low as the minimum heat output percent, if the current temperature is above the heat set point temperature; and (5) turning off the variable rate heater if the heat output of the variable rate heater remains at the minimum heat output percent without being adjusted upwards for a timeout period.

14. The method of claim 13 wherein the dead-band value is 0.1 degrees Fahrenheit.

15. The method of claim 13 wherein the timeout period is at least 90 seconds.

16. The method of claim 13 wherein the minimum heat output is between 0% and 50%.

17. The method of claim 13 further including the steps of:

(a) accepting a daily required temperature input by a user, the daily required temperature being higher than the heat set point temperature; and (b) turning on a ventilation system when the current room temperature exceeds the daily required temperature.

18. A temperature control system for use in an animal confinement building, (a) the temperature control system including:

(1) a variable rate heater which, when turned on, has a heat output ranging from a minimum heat output percent to a maximum heat output percent, the minimum heat output percent being smaller than the maximum heat output percent; and (2) a temperature sensor;

(b) wherein the system is configured to:

(1) accept from a user a heat set point temperature and a daily required temperature;

(2) measure a current temperature using the temperature sensor;

(3) turn on the ventilation system when the current temperature exceeds the daily required temperature;

(4) determine a difference between the current temperature and the heat set point temperature;

(5) leave the heat output of the variable rate heater unchanged at a current heat output while the difference is no greater than a dead-band value;

(6) if the difference is greater than the dead-band value:

(A) determine an error correction based on both the difference and on one or more past error corrections, the one or more past error corrections having been determined based on one or more prior temperature readings, the error correction having:

(i) a proportional relationship with the difference;

(ii) an integral relationship with the one or more past errors;

(B) set the heat output of the variable rate heater to an adjusted heat output based on the error correction, the adjusted heat output being:

(i) greater than the current heat output, up to the maximum heat output percent, if the current temperature is below the heat set point temperature; and (ii) lower than the current heat output, as low as the minimum heat output percent, if the current temperature is above the heat set point temperature; and (7) turn off the variable rate heater if the heat output of the variable rate heater remains at the minimum heat output percent without being adjusted upwards for a timeout period.

19. The system of claim 18 wherein the dead-band value is 0.1 degrees Fahrenheit.

20. The system of claim 18 wherein the timeout period is at least 90 seconds.

21. The system of claim 18 wherein the minimum heat output is no higher than 25%.

22. The system of claim 18 wherein the minimum heat output is between 0% and 50%.

* * * * *